US007596923B1

(12) United States Patent
Thomas et al.

(10) Patent No.: US 7,596,923 B1
(45) Date of Patent: Oct. 6, 2009

(54) METHOD OF CONSTRUCTING BUILDING FOUNDATION HAVING WALL STRUCTURAL ELEMENT EMBEDDED IN SECOND FOUNDATION ELEMENT LOCATED ON TOP OF FIRST FOUNDATION ELEMENT

(76) Inventors: Tammy Thomas, 1293 Lake Trace Love, Hoover, AL (US) 35244; Thomas Herren, 608 Caryoliah Rd., Crossville, TN (US) 38571

( * ) Notice: Subject to any disclaimer, the term of this patent is extended or adjusted under 35 U.S.C. 154(b) by 0 days.

(21) Appl. No.: 10/956,422

(22) Filed: Oct. 1, 2004

(51) Int. Cl.
*E02D 27/32* (2006.01)
*E04G 21/00* (2006.01)

(52) U.S. Cl. ..... 52/741.13; 52/274; 52/293.3; 52/295; 52/741.15

(58) Field of Classification Search ..... 52/741.15, 52/293, 293.1, 293.3, 299, 274, 273, 241, 52/242, 293.2, 294, 295, 741.13; 405/267; 249/34, 35, 28
See application file for complete search history.

(56) References Cited

U.S. PATENT DOCUMENTS

| | | | | |
|---|---|---|---|---|
| 2,200,636 A | | 5/1940 | Palmer | |
| 2,815,656 A | * | 12/1957 | Klein et al. | 52/169.1 |
| 2,883,852 A | | 4/1959 | Midby | |
| 3,216,163 A | | 11/1965 | Carew | |
| 3,820,295 A | * | 6/1974 | Folley | 52/270 |
| 4,263,762 A | | 4/1981 | Reed | |
| 4,569,173 A | * | 2/1986 | Hultquist | 52/293.1 |
| 4,756,133 A | | 7/1988 | Madray | |
| 5,493,834 A | * | 2/1996 | Nelson | 52/349 |
| 5,511,761 A | | 4/1996 | Schultz | |
| 5,685,115 A | | 11/1997 | Colfer | |
| 5,882,540 A | | 3/1999 | Farrington | |
| 5,922,236 A | | 7/1999 | Zuhl | |
| 6,076,320 A | | 6/2000 | Butler | |
| 6,260,318 B1 | * | 7/2001 | Herren | 52/317 |
| 6,332,599 B1 | * | 12/2001 | Spartz | 249/34 |
| 6,389,778 B1 | * | 5/2002 | Strange | 52/745.19 |
| 6,568,141 B2 | | 5/2003 | Kremers | |
| 2003/0167722 A1 | * | 9/2003 | Klein et al. | 52/653.1 |

* cited by examiner

*Primary Examiner*—Gay Ann Spahn
*Assistant Examiner*—Daniel Kenny
(74) *Attorney, Agent, or Firm*—Bradley Arant Boult & Cummings LLP

(57) ABSTRACT

The present disclosure describes a novel method for preparing a finished foundation comprising an embedded wall structural element comprising the steps of (i) preparing a building site to receive the finished foundation; (ii) providing a first foundation element and securing at least one wall structural elements to the first foundation element; and (iii) providing a second foundation element to secure at least a portion of the at least one wall structural elements to the finished foundation. Structures prepared using the methods disclosed herein provide for wall structural elements, and therefore, the finished wall and the structure as a whole, of increased strength and resistance to forces encountered during extreme conditions.

27 Claims, 5 Drawing Sheets

METHOD OF CONSTRUCTING BUILDING FOUNDATION HAVING WALL STRUCTURAL ELEMENT EMBEDDED IN SECOND FOUNDATION ELEMENT LOCATED ON TOP OF FIRST FOUNDATION ELEMENT

FIELD OF THE DISCLOSURE

The instant disclosure relates to building construction in general, and particularly to a building construction method comprising embedding a pre-formed wall structural element into a foundation element of a structure.

BACKGROUND

Many conventional building structures utilize a concrete footings and/or foundation (collectively referred to as a "foundation") to provide a suitable substrate to support the structure and anchor the structure to the earth. The preparation of the foundation, however, is a time consuming process which adds a significant amount of expense to the building structure. Generally, the foundation is prepared using board forms and stakes to define the contours of the foundation. While such conventional methods offer design flexibility, they have significant drawbacks. These drawbacks include wasted materials required to construct the forms, wasted labor to construct the forms and to check geometry of the forms, poor accuracy of the foundation surfaces and embedded elements, and difficulty in adjusting form locations after stakes are set. Accuracy of the completed foundation is also a concern, with an improperly constructed foundation resulting in inaccuracies in the building elements to be secured to the footing and foundation, such as during the framing process where framing members are secured to the foundation. This inaccuracy has a more consequential negative affect on the framing process for a structure comprising metal framing members since these structures require precise positioning.

Furthermore, once the preparation work for the foundation is completed, the concrete slab of the structure must be poured and the wall structure elements must be secured to the completed foundation. Generally, the flaming members are typically constructed from wood or metal members and are secured to runners which are secured directly to the foundation such as with concrete nails, bolts and other similar methods as is known in the art. While these methods of securing the framing members to the foundation are relatively quick and simple and meet existing building code requirements, they fail to provide the structural strength for the finished wall so that the structure can withstand the forces applied to it during severe conditions, such as earthquakes and severe weather conditions (i.e., tornados and hurricanes and the like).

What the art is lacking is a method which allows wall structure elements to be secured to the foundation in such a manner that the finished wall can withstand sever conditions without structural failure. Furthermore, such method should ideally allow a simplified process for constructing the foundation and the slab components of the building structure. The present disclosure provides such a solution that has not been previously appreciated in the field.

DETAILED DESCRIPTION

Figure 1A:
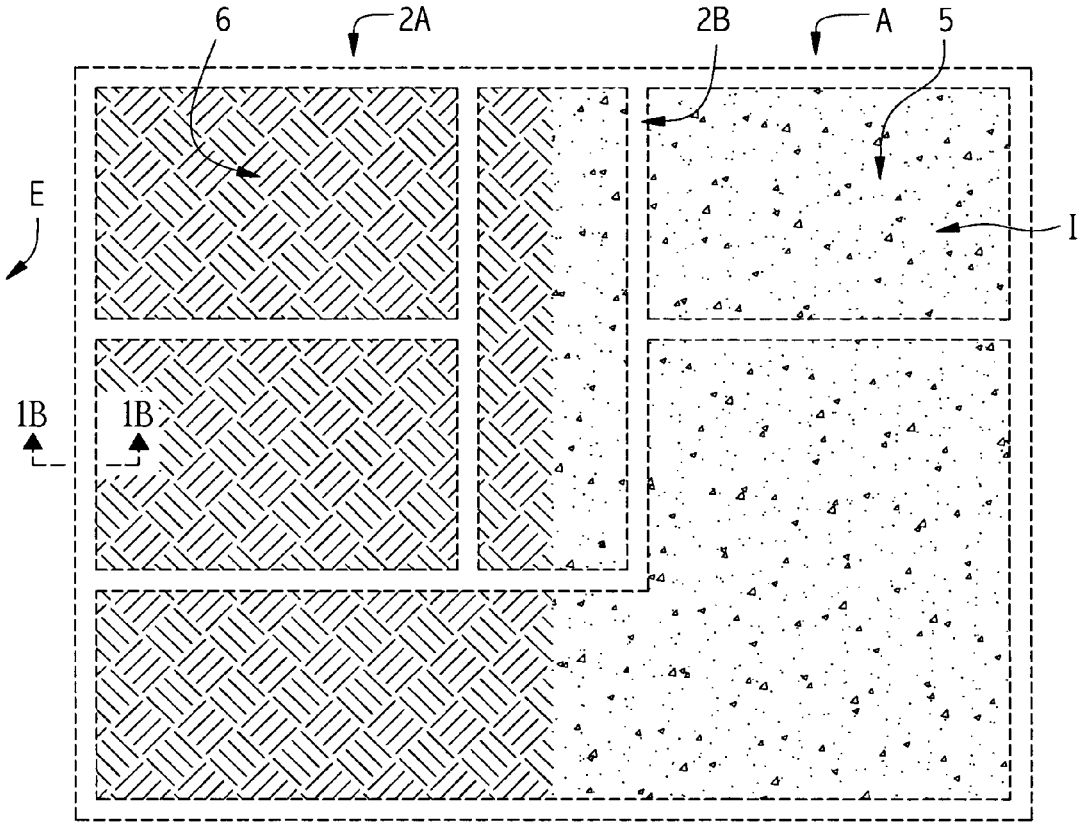
FIG. 1A illustrates a plan view of a building site illustrating one arrangement of the perimeter and interior channels.

The present disclosure details a building construction method that provides for the placement of one or more wall structural elements into the foundation of a building structure. A wall structural element is defined herein as any element used to provide a frame for a structure, such as the metal wall structural element described herein. In one embodiment, the wall structural element may be a pre-formed unit comprising a plurality of metal studs and a longitudinal beam connecting the studs at their bottom ends. This pre-formed unit may further comprise structural reinforcing elements joining the metal stud. The embedding of a wall structural element directly into a foundation provides a finished wall many times stronger than a finished wall created using commonly used construction techniques (as discussed below) and which greatly exceeds the requirements of all building codes. Furthermore, this method provides for the simultaneous pouring of the foundation of the building structure at the time the wall structure elements are secured into the foundation. This eliminates the need to secure the wall elements to the foundation after the foundation hardens. Furthermore, the method described provides a novel method of site preparation which in combination with the wall structural elements described, eliminates the need to use conventional wooden stake forms to prepare the foundation and/or the slab.

The building construction method described can be used to construct a variety of residential and commercial structures. As used in this specification, the term "building" or "structure" is intended to encompass the widest possible variety of structures, both commercial and residential, whether or not designed for human occupancy. In addition, a variety of wall structural elements can be used with the method disclosed. While the specification describes several embodiments in considerable detail, one of ordinary skill in the art would realize additional wall structural elements could be incorporated into the method described and would be able to make the substitution without undue experimentation.

Generally, construction methods tend to rely on a uniform set of principles during the construction of a building. One reason for this consistency is a set of uniform building codes that apply across the country. Another reason is familiarity and costs. That is, the older techniques are know to the construction crews and produce known results, which lowers the time, and therefore the costs, involved in the construction. This is one reason new construction techniques, such as those described in the instant application, are not common in the industry. However, the method described is simple to use and to teach and may utilize pre-formed elements, making acceptance of the method far more likely.

In the prior construction methods, site preparation involves clearing the site of any trees, rocks and debris and leveling the site if necessary. Furthermore, site preparation involves creating earthworks (such as trenches or other structures) as required for the type of foundation to be used for the structure being built. A variety of foundation types are possible. For structures built on a slab foundation, site preparation would involve preparing a trench defining the perimeter of the structure and preparing the pad to receive the concrete slab. The trench is generally about 18 to 24 inches wide and 18 to 24 inches deep. The trench is then prepared to receive the concrete that will form the support for the foundation/slab. In addition, both the foundation and the slab may contain reinforcing elements for additional strength. After the form is constructed and the pad prepared, the concrete can be poured to form the foundation, including the slab.

Once the concrete hardens, it forms the foundation on which the structure rests. The width of the foundation element, and therefore the prepared trench, is controlled in part by the compressibility of the soil. In light soils, the foundation element will be wider to try to spread out the load, while in heavy clay soils it can be narrower.

After the concrete is in place and has cured sufficiently, the framing members are then secured to the foundation. For a slab foundation, the framing members are typically secured directly to the concrete, such as by bolt, nails or other means as is known in the art. While this method is relatively simple to perform, the strength of the finished wall and the structure as a whole is limited by the strength of the attachment of the framing members to the foundation. In most cases, the resistance of the finished wall and the structure as a whole formed using the method above to shear forces generated during extreme conditions (such as sever weather) is in the range of 40 lbs/square foot. Such resistance is of limited value. Using the methods disclosed herein, finished walls can be provided that can withstand forces in the range of 500 lbs/square feet.

General Methodology

In a general embodiment, the novel method described involves the steps of (i) preparing a building site; (ii) providing a first foundation element and securing at least one wall structural elements to the first foundation element; and (iii) providing a second foundation element to secure at least a portion of the at least one wall structural elements to the finished foundation. Each step of the method is described in greater detail below. It should be noted that the details below provide examples of specific embodiments of methods to accomplish each step. Alternate methods may be used to accomplish each step as is described below and as is known in the art.

Preparing the Building Site

The present method provides several advantages in site preparation. The description below will describe in detail the preparation of a site for an on-grade slab foundation. However, the principles involved can be easily translated to other types of foundations, such as, but not limited to, T-foundations and frost protected foundations, as would be known to one of ordinary skill in the art in the field. Furthermore, although one method of site preparation is described in detail, it will be understood that additional site preparation methods may also be used and that the exact site preparation methods may be dictated by the site conditions (i.e., soil density), building plans and other factors. Therefore, the embodiment below is provided for illustrative purposes only.

Figure 1B:
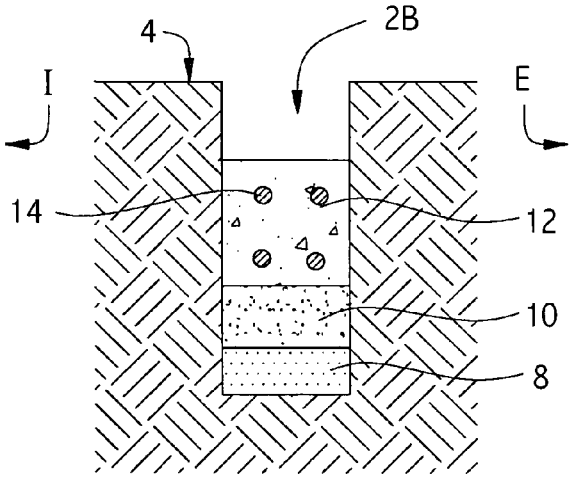
FIG. 1B illustrates a cross sectional view taken along line 1B of FIG. 1A of a perimeter channel.

In many regards the site A is prepared as with sites for use with conventional building techniques (see FIG. 1A). In one embodiment, the entire site is prepared so that it is level as determined by a laser leveling system as is known in the art. Channels to receive the first foundation element are then prepared. The perimeter channels 2A and interior channels 2B are laid out to define the exterior perimeter of the ultimate structure and to define the interior of the structure, respectively, and will serve as the anchor point for the exterior and interior wall structural elements, respectively, of the structure once the concrete has been poured and hardened. The channels may be of any depth and width as is appropriate for the conditions required for the structure being built. In one embodiment, the channels 2A and 2B are two (2) feet deep and two (2) feet in width. The area on the interior sides I of the channels is the leveled pad 4 (which will be further prepared as described below) which will receive the concrete slab 6. Interior channels 2B may extend into the interior I of the pad to receive the interior walls of the structure. These interior channels may have the same dimensions as the exterior channels or may have different dimensions. A plan view of a typical layout illustrating the perimeter 2A and interior 2B channels, the prepared pad and concrete slab 6 is shown in FIG. 1A and a cross sectional view (taken along line 1B) of a perimeter channel illustrating the preparation of one embodiment is illustrated in FIG. 1B. The area on the exterior side of the perimeter channels 2B is indicated by the reference character E.

Once the channels and the pad are formed and leveled, they may undergo additional preparation. In one specific embodiment, four (4) inches of appropriate fill material (indicated as 8) is added to the pad and the channels and compacted to meet CCF-1 standards. This is followed by an additional six (6) inches of gravel (indicated as 10), which is spread and compacted (indicated as 5 in FIG. 1A). Once prepared, the pad and the channels are ready to receive the first foundation element (indicated as 12). The prepared site is also checked to ensure the site is level as discussed above. It should be noted that no forms are required in subsequent steps in the procedures to define the channels, the pad or other foundation elements. The wall structural elements to be incorporated in the perimeter channels will serve as a barrier to ensure that the concrete poured to form the foundation is retained as required. This elimination of forms saves cost both in terms of manpower required to create the forms and the expense of the materials to create the form.

Providing the First Foundation Element

Once the site A has been prepared, it is then ready to receive the first foundation element 12. The first foundation element serves to allow an initial anchor point for the wall structural elements. The first foundation element is placed in the perimeter 2A and interior 2B channels constructed as discussed above. The exact embodiment of the first foundation element 12 can take on various forms so long as the structural support for the wall structural elements is provided.

Figure 2A:
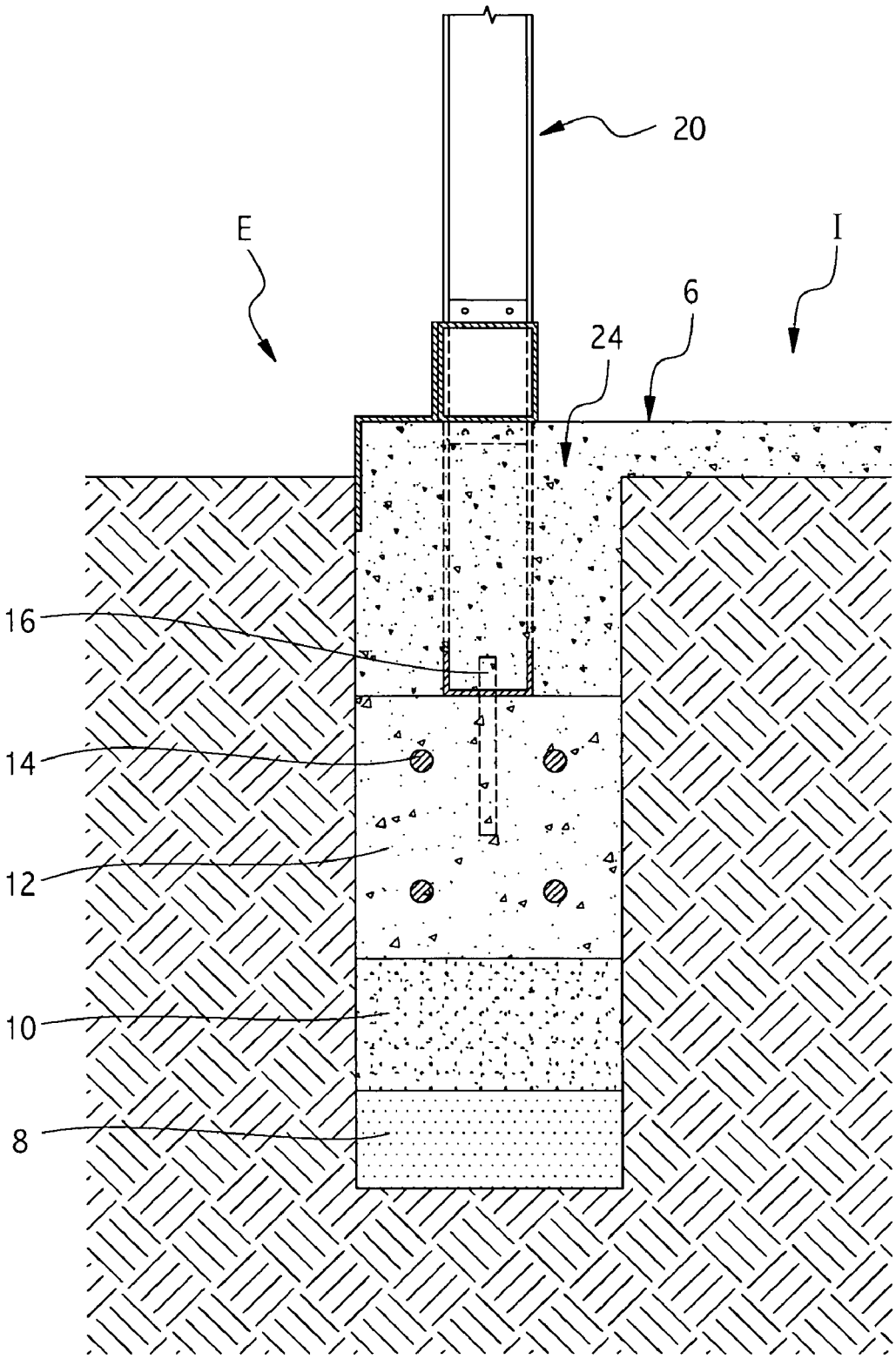
FIG. 2A illustrates a side view of a perimeter channel with an attached wall structural element.

In one embodiment, the first foundation element 12 is a layer of concrete poured into the perimeter 2A and interior 2B channels. This embodiment is illustrated in FIGS. 1B and 2A with FIG. 2A showing a section of a wall structural element secured to the concrete which serves as the first foundation element 12. The concrete is poured by methods known in the art. The amount of concrete added to form the first foundation element will vary depending on the configuration of the perimeter and interior channels. The amount of concrete added is sufficient to provide structural support to the wall structural elements. In the embodiment where the channels are each two (2) feet wide and two (2) feet deep, sufficient concrete may be added so that the concrete forming the first foundation element extends approximately one (1) foot in depth. The depth of the first foundation element can vary, so long as a secure initial anchor for the wall structural elements is provided.

Any type of concrete suitable for residential or commercial applications may be used, such as but not limited to, types I-V concrete mixtures. The type of concrete used to form the first foundation element 12 may vary depending on the soil condition, the climate, the strength required and other factors. In addition, the standard concrete types may be modified as would be known to one of skill in the art when presented with the conditions presented by a particular project.

Furthermore, the concrete forming the first foundation element 12 may comprise reinforcing structures such as reinforcing rods 14 or wire mesh as is known in the art. The concrete forming the first foundation element 12 may also comprise anchor points extending upwards from the surface of the concrete that serve to secure the wall structural elements 20 to the first foundation element 12. These anchor points may be reinforcing rods of various dimensions, bolts or similar structures. A bolt 16 is illustrated as the anchor point in FIG. 2A. The exact embodiment of the anchor points is not critical provided the anchor points allow the wall structural elements 20 to be placed in their initial configuration in the perimeter 2A and interior 2B channels. The wall structural elements 20 will be further secured as discussed below.

Figure 2B:
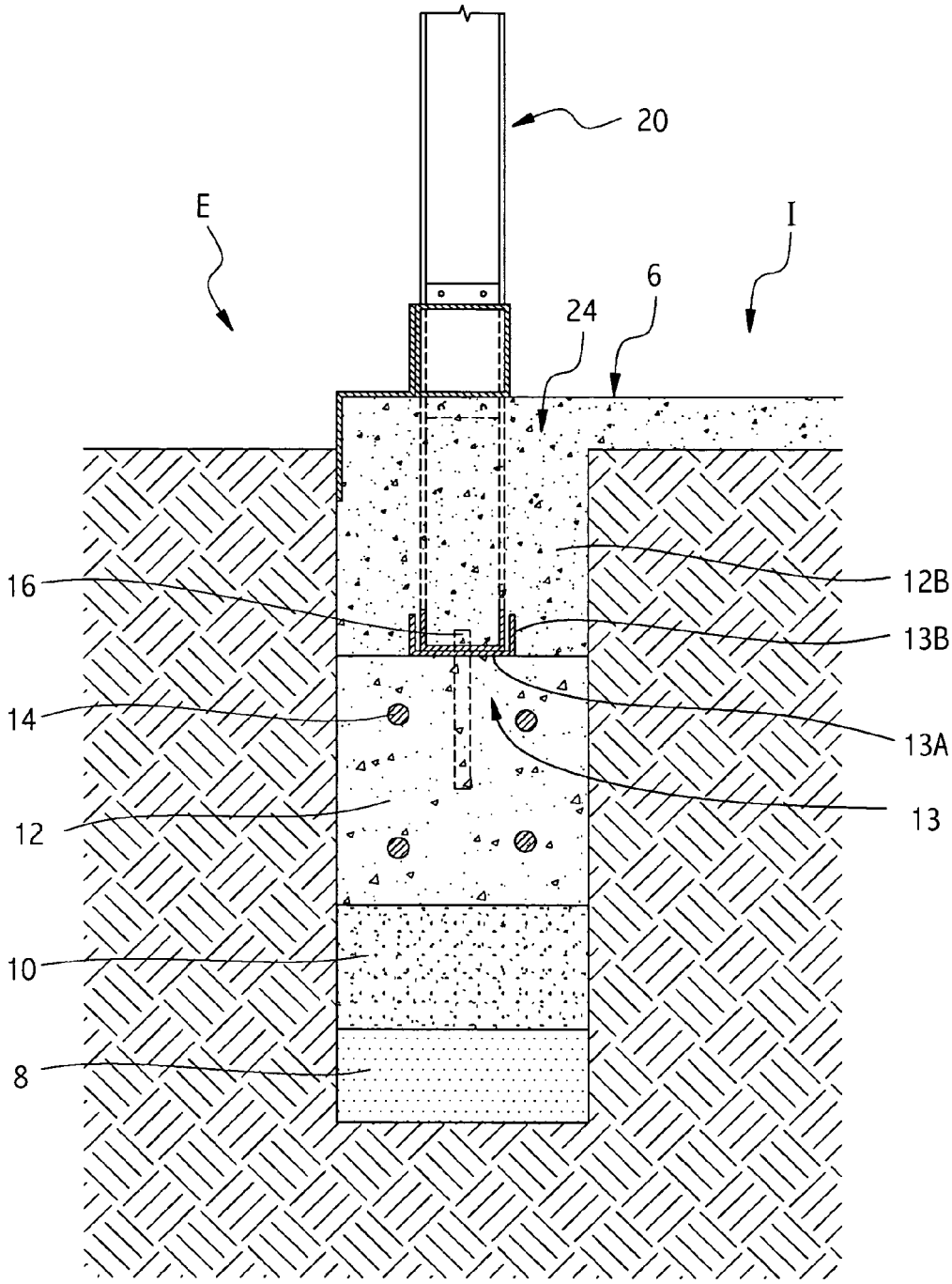
FIG. 2B illustrates a side view of a perimeter channel with an attached wall structural element with an alternate embodiment of the first foundation element.

In an alternate embodiment, the first foundation element 12 may further comprise a receiving track 13 placed on the top surface concrete forming the first foundation element in perimeter 2A and interior 2B channels. This embodiment of the first foundation element 12 is illustrated in FIG. 2B with FIG. 2B showing a section of a wall structural element 20 secured to the receiving track 13. The receiving track 13 may be secured to the concrete forming the first foundation element in perimeter 2A and interior 2B channels and secured thereto by reinforcing rods, stakes, bolts or similar methods (indicated as bolt 16B in FIG. 2B).

The track is configured to receive the bottom end of the wall structural elements 20 (which are described below). In one embodiment, the receiving track 13 may have a base 13A and two wall portions 13B and be generally in the form of a U-shaped channel. In an alternate embodiment, the receiving track may have a base 13A and one (1) side wall 13B and be generally in the form of an L-shaped channel. In both embodiments, the side wall portion(s) may help to support the wall structural elements 20 prior to being secured to the receiving track. In this embodiment, the bolt 16 (or reinforcing rod, stake, or similar device) may also serve to secure the wall structural elements 20 to the receiving track 12B. In addition, if the receiving track 12B and the wall structural elements 20 are constructed from metal, the wall structural elements 20 may be welded to the receiving tracks 12B. The weld may be a continuous weld or a spot weld.

Once the first foundation element 12 is constructed as discussed above, the individual wall structural elements 20 are placed on the first foundation element 12 and secured thereto as described above. Pre-formed sections of wall structural elements 20 may be placed on the first foundation element and secured thereto, or the wall elements may be constructed directly on the first foundation element 12. Obviously, the use of pre-formed sections of the wall structural elements 20 will facilitate construction of the structure and reduce the labor and time required during construction. When pre-formed section of the wall structural elements 20 are used, the pre-formed sections may be placed in an initial position using a crane or similar device and secured to the first foundation element 12. The wall structural elements 20 are secured to the first foundation element 12 such that they may be adjusted in order to allow final placement of the wall structural elements 20. For instance the wall structural elements 20 may be secured to the first foundation elements via the anchor point, such as bolt 16. As the wall structural elements 20 are added to the first foundation element 12, they may be manipulated so that the wall structural elements 20 are aligned in a manner suitable for the construction desired as is known in the art. In addition, the individual sections of the wall structural elements 20 can be secured together to form the desired wall configuration for the desired structure. In one embodiment, the wall elements are secured by welding using a suitable welding agent. After final placement, the integrated sections of the wall structural elements 20 may be further secured to the first foundation element 12, or may be braced as is known in the art so that the integrated wall structural elements 20 retain their final placement.

One function of the first foundation element 12 is to provide support and stabilization of the wall structural elements 20 as and after they are secured to the first foundation element 12 and during the alignment process. In addition, the first foundation element 12 supports the wall structural elements 20 until the second foundation element 24 can be provided, which serves to permanently secure the wall structural elements 20 in place. After the wall structural elements 20 are secured to the first foundation element as described, the second foundation element 24 is provided.

Providing the Second Foundation Element

The second foundation element serves to secure the wall structural elements 20 (which are secured to the first foundation element 12 as described above) permanently in place and serves to complete the foundation for the structure (which includes forming the finished slab 6). As discussed above in the initial site preparation section, no forms are required to create the foundation using the method described. The design of the wall structural elements 20 which are secured to the firsts foundation element 12 in the perimeter channels 2A allows the concrete poured during the creation of the second foundation element 24 to be retained within the inner area I of the structure and allows the formation of the final foundation (i.e., the slab 6 and the combination of the first 12 and second 24 foundation elements). Once the wall structural elements 20 are in place, the second foundation element may be provided. In one embodiment, wall structural elements 20 are place along the entirety of the perimeter channels 2A. In this embodiment, the second foundation element is added in one stop and secures the wall structural elements in place within the perimeter 2A and interior channels 2B and forms the slab. In the alternate embodiment, one or more dividing forms may be provided along the interior of the structure such that the foundation element 24 is added in more than one step. The dividing form retains the second foundation element 24 one side, with the wall structural elements 20 retaining the second foundation element within the perimeter channels 2A as described below.

A variety of wall structural elements 20 may be used with the methods described herein. In one embodiment, the wall structural elements 20 are constructed from a metal material, such as but not limited to, galvanized steel. In one embodiment, wall structural elements 20 may be formed of metal studs as is common in the industry.

Metal studs are typically formed of galvanized steel and bent to encompass a cross sectional area having nominal dimensions of two inches by four inches. To conform to architectural plans and building code requirements, metal studs are formed into generally U-shaped cross-section in which a relatively broad central base (sometimes referred to as the web) is flanked by a pair of narrower sides that are bent at right angles to the base. The sides of the U-shaped studs typically extend a nominal distance of two inches from the base and are commonly referred to as flanges. To enhance structural rigidity the flanges, the flanges may be bent over into a plane parallel to and spaced from the plane of the web.

These turned over edges of the sides thereby form marginal lips. Conventionally, the metal studs are erected with the webs oriented on the same side in the same direction.

The wall structural elements 20 may further comprise transverse member joining the metal studs and being in a generally perpendicular relationship to the metal studs. The transverse member provides additional strength and rigidity to the wall structural elements and the finished wall. A variety of methods of providing such transverse reinforcement are known in the art and any such method is suitable for use with the wall elements as described. In one embodiment, the transverse members are the unitary metal bridge, fire stop and backing device as described in U.S. Pat. No. 6,260,318. In an alternate embodiment, the transverse members are the bridging and backing device described in U.S. Pat. No. 5,189,857. The patent specification of each of these patents is hereby incorporated by reference as is fully set forth herein. The transverse member provides both lateral stability to the wall and also can provide reinforcement against forces acting normal to the wall. In many instances, transverse reinforcement is required by the building codes.

Figure 3:
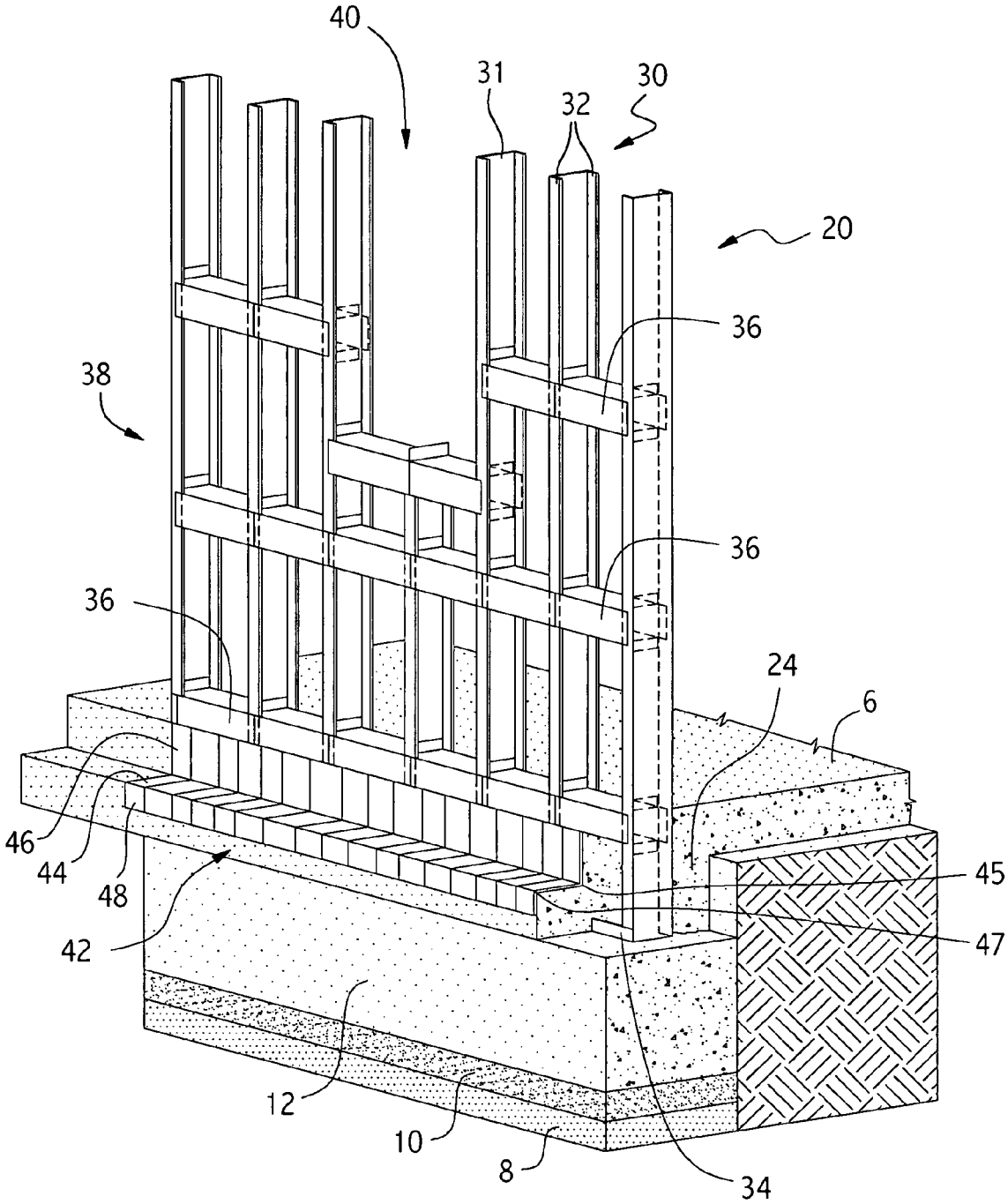
FIG. 3 illustrates a perspective view of the first and second foundation elements with the embedded wall structural element.

FIG. 3 illustrates an exemplary wall structural element 20 embodying the principles discussed herein. While FIG. 3 shows a certain embodiment as a specific application of the present disclosure, variations in the wall structure may be made as is known in the art as discussed above. In this embodiment, the wall structural element 20 comprises metal stud members 30 with a base 31 and side walls 32. The metal stud members 30 extend horizontally in the configuration described above. The studs 30 are secured to a base member 34 at their bottom ends. The metal stud members 30 are joined transversely by transverse members 36 as described in U.S. Pat. No. 6,260,318. In this example, the transverse members are formed by securing two (2) of the metal bridge, fire stop and backing devices together (such as by welding) so that the transverse members have a generally rectangular cross section. Alternatively, the 1 transverse members 36 may be manufactured in the form as illustrated.

The wall structural element 20 is shown secured to the first foundation element 12, which in this figure is illustrated as a concrete base of approximately one (1) foot in depth. In such a configuration, the transverse members 36 provide a wall structural element 20 with greatly increased strength to horizontal and lateral forces as compared to wall structures known in the art. Further advantages to this structure are described in U.S. Pat. No. 6,260,318.

The wall structural element 20 illustrated comprises a front side 38 (which faces the exterior E) and a back side 40 (which faces the interior I). The front side 38 of the wall structural element 20 incorporates a retaining flange which serves to retain the concrete used to form the second foundation element 24 in the perimeter channel 2A and within the interior of I of the structure. In one embodiment, the means for retaining is a flange 42. As can be seen in FIG. 3, the wall structural element 20 is not a solid structure, meaning that the concrete when added to form the second foundation element 24 and the slab 6 will flow through the gaps in the wall structural element 20 and into the perimeter channel 2A. Without a means to limit the flow of concrete, the concrete would extend upward in the perimeter channel 2A until it found a level equal to the concrete on the interior portion of the structure. In many cases it is desirable to have the slab 6 slightly above the remainder of the foundation structure. This will allow for earth or other material to be backfilled into the perimeter channel 2A and present a more aesthetically pleasing appearance to the finished structure. In addition, in some cases, the concrete may extend beyond the confines of the perimeter channel 2A, presenting problems in clean-up and wasted construction materials.

The flange 42 extends along the entire length of the front side 38 of the wall structural element 20. The flange 42 at a minimum comprises a base portion 44 extending from the front side 38 of the wall structural element 20. The base portion 44 may be joined directly to the front side 38 and may angle downwardly from the front side 38, and into the perimeter channel 2A. Alternatively, the base portion 44 may further comprise a first lip 46 extending from a first side 45 of the base portion 44 and forming a generally perpendicular angle with base portion 44. The first lip 46 may be joined to the front side 38. In this embodiment, the base portion 44 extends horizontally away from the front side 38 and is substantially perpendicular thereto. The first lip 46 is substantially parallel to the front side 38 and may extend downward into the perimeter channel 2A to join the base portion 44 at first side 45.

The width (indicated as X in FIG. 3) of the base portion 44 is sufficient to extend substantially across the distance from the front side 38 of the wall structural element 20 to the side wall of the perimeter channel 2A adjacent to the exterior E. Therefore, the width of the base portion of the flange can be varied depending on the width of the perimeter channel 2A. In this manner, the sides of the perimeter channel 2A also serve to limit the flow of concrete in the perimeter channel. Alternatively, the flange may further comprise a second lip 48. The second lip 48 extends downwardly from the second side 47 of the base portion 44 and forms a generally perpendicular angle with the base portion 44. The downwardly turning second lip further aids in retaining the concrete in the perimeter channel.

The flange 42 may be placed at any portion of the wall structural element 20 as desired. In the embodiment illustrated in FIG. 3, the wall structural element 20 is secured to one of the transverse sections 36. As the length of the first lip 46 may be varied to place the base portion 44 at the desired location, the position of attachment is not critical. In one embodiment, the base portion 44 is placed below the level of the slab 6. In this embodiment, the base portion 44 will extend into the perimeter channel 2A. The exact position of the base 44 relative to the slab 6 is not critical to the present disclosure, but in the embodiment where the base portion 44 is situated below the level of the slab 6, it may allow for backfilling of the perimeter channel 2A with appropriate fill material so that the structure has a more pleasing finished appearance.

Figure 4:
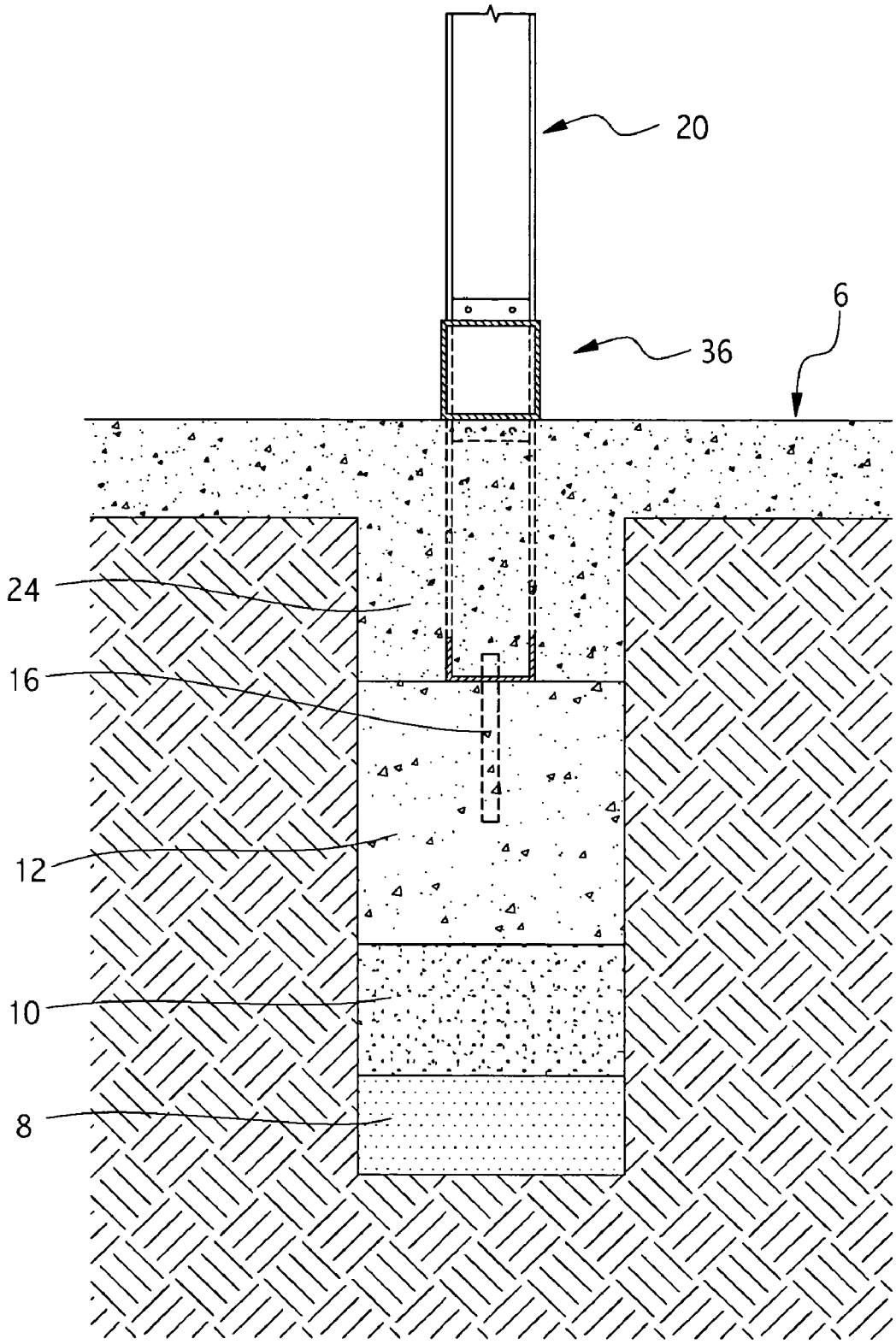
FIG. 4 illustrates a side view of an interior channel with an attached interior wall structural element.

The wall structural elements to be placed in the interior channels 2B may be identical to the wall structural elements 20 placed in the perimeter channels 2A, with the difference that the wall structural elements 20 to be placed in the interior channels 2B lack the flange 42. These wall structural units may be referred to as "interior wall structural elements". The flange 42 is not required since it is desirable for the concrete added to form the second foundation element 24 and the slab 6 flows through the wall structural elements 20 placed in the interior channels 2B. An embodiment of the wall structural elements 20 as placed in an interior channel 2B is shown in FIG. 4.

The individual wall structural elements 20 may be joined as is known in the art and discussed above. In one embodiment, the individual wall structural elements 20 are welded together. An additional flange piece 42 may be added at the corners if desired. All references disclosed herein are incorporated by reference as if set forth herein in their entirety.

What is claimed is:

1. A method for providing a finished foundation for a building, said finished foundation comprising at least one wall structural element embedded into said finished foundation, said method comprising the steps of:

a. providing a perimeter channel defining the perimeter of the building, said perimeter having an interior portion and an exterior portion;

b. providing a first foundation element in said perimeter channel;

c. providing said at least one wall structural element, said wall structural element comprising a front side facing said exterior portion and a back side facing said interior portion, and a retaining flange permanently secured to the wall structural element, said retaining flange extending along substantially the entire length of the front side of said wall structural element and secured to the front side of said wall structural element, where a portion of said retaining flange extends in a horizontal direction away from the front of the wall structural element;

d. securing the at least one wall structural element to said first foundation element such that the retaining flange faces the exterior portion;

e. providing a second foundation element to secure the at least one wall structural element in said perimeter channel, said second foundation element being retained within the perimeter channel and the boundary of the second foundation element being defined by the retaining flange, such that the wall structural element is embedded within the second foundation element, the second foundation element contacting and completely surrounding at least a portion of the front side of the wall structural element, the second foundation element contacting and surrounding at least a portion of the back side of the wall structural element, said second foundation element having a first portion and a second portion, the height of the second portion being less than the height of the first portion and at least part of the second portion extending beyond the front side of the wall structural element.

2. The method of claim 1 where at least one wall structural element further comprises a plurality of metal studs in a generally vertical position, a plurality of transverse members joining said metal studs and being in a generally perpendicular relationship to said metal studs, and a base member joining a bottom end of said metal studs.

3. The method of claim 1 where the first foundation element and the second foundation element are concrete.

4. The method of claim 3 where one of the first foundation element and the second foundation element further comprises a reinforcing member.

5. The method of claim 1 where the first foundation element comprises an anchor point and said at least one wall structural element is secured to the anchor point.

6. The method of claim 5 where the anchor point is a bolt and the at least one wall structural element is secured to the bolt with a nut.

7. The method of claim 2 where the retaining flange comprises a base portion having a first side and a second side, said base portion being generally perpendicular to the front side and a first lip, said first lip joining the base portion at said first side of the base portion and being generally perpendicular to the base portion, said first lip being secured the front side of the at least one wall structural element.

8. The method of claim 7 where said first lip is secured to one of the plurality of transverse members.

9. The method of claim 7 where said perimeter channel comprises an interior side adjacent to said interior portion and an exterior side adjacent to said exterior portion and the base portion of the flange spans the distance from the front side of the at least one wall structural element to the exterior side of said perimeter channel.

10. The method of claim 7 where the retaining flange further comprises a downwardly extending second lip, said second lip joining the base portion at a second side of the base portion opposite the first lip and being generally perpendicular to the base portion.

11. The method of claim 7 where said base portion, said first lip and second lip retain the second foundation element within the interior portion.

12. The method of claim 2 where the components of the at least one wall structural element are manufactured from galvanized steel.

13. The method of claim 1 where the perimeter channel further comprises a first layer of material and a second layer of material.

14. The method of claim 13 where the first layer of material is a compacted fill material and the second layer of material is a compacted gravel.

15. The method of claim 1 further comprises providing at least one interior channel defining at least one interior wall of the building to receive at least one interior wall structural element embedded into the finished foundation, said at least one interior channel located in the interior portion.

16. A method for providing a finished foundation for a building, said finished foundation comprising at least one wall structural element embedded into said finished foundation, said method comprising the steps of:

a. providing a perimeter channel defining the perimeter of the building, said perimeter having an interior portion and an exterior portion;

b. providing a first foundation element in said perimeter channel;

c. providing said at least one wall structural element, said wall structural element comprising a front side facing said exterior portion and a back side facing said interior portion, and a retaining flange permanently secured to the wall structural element, said retaining flange extending along substantially the entire length of the front side of said wall structural element and secured to the front side of said wall structural element, where a portion of said retaining flange extends in a horizontal direction away from the front of the wall structural element;

d. securing the at least one wall structural element to said first foundation element such that the retaining flange faces the exterior portion;

e. providing a second foundation element to secure the at least one wall structural element in said perimeter channel, said second foundation element being retained within the perimeter channel and the boundary of the second foundation element being defined by the retaining flange, said second foundation element having a first portion and a second portion, the height of the second portion being less than the height of the first portion and at least part of the second portion extending beyond the front side of the wall structural element;

said method further comprising:

f. providing at least one interior channel defining at least one interior wall of the building to receive at least one interior wall structural element embedded into the finished foundation, said at least one interior channel located in the interior portion, said method farther comprising g. providing a first foundation element in said interior channel; and h. proving at least one interior wall structural element;

i. securing the at least one interior wall structural element to said first foundation element;

j farther securing the at least one interior wall structural element to the first foundation element by providing a second foundation element to secure the at least one wall structural element in said perimeter channel, said second foundation element being retained within the interior portion by said retaining flange.

17. The method of claim 16 where at least one interior wall structural element further comprises a plurality of metal studs in a generally vertical position, a plurality of transverse members joining said metal studs and being in a generally perpendicular relationship to said metal studs, and a base member joining a bottom end of said metal studs.

18. The method of claim 16 where the first foundation element and the second foundation element are concrete.

19. The method of claim 16 where one of the first foundation element and the second foundation element further comprises a reinforcing member.

20. The method of claim 16 where the first foundation element comprises an anchor point and said at least one interior wall structural element is secured to the anchor point.

21. The method of claim 20 where the anchor point is a bolt and the at least one interior wall structural element is secured to the bolt with a nut.

22. The method of claim 17 where the components of at least one wall structural element are manufactured from galvanized steel.

23. The method of claim 16 where said interior channel comprises a first layer of material and a second layer of material.

24. The method of claim 23 where the first layer is a compacted fill material and the second layer is a compacted gravel.

25. The method of claim 3 where the first foundation element further comprises a U-shaped track secured to said first foundation element to receive the at least one wall structural element.

26. The method of claim 16 where the first foundation element further comprises a U-shaped track secured to said first foundation element to receive the at least one wall structural element.

27. The method of claim 1 where the retaining flange comprising a base portion having a first side and a second side, an upwardly extending first lip portion in communication with the first side of the base portion and a downwardly extending second lip in communication with the second side of the base portion, the base portion being generally perpendicular to the wall structural element and extending in a horizontal direction away from the exterior side and the first and second lip portions being generally perpendicular to the base portion.

* * * * *